US005929828A

United States Patent [19]

Beeteson et al.

[11] Patent Number: 5,929,828

[45] Date of Patent: Jul. 27, 1999

[54] MAGNETIC MATRIX DISPLAY DEVICE USING ORTHOGONAL CONDUCTORS

[75] Inventors: John Beeteson, Skelmorlie; Shaun Kerigan, Kilmalcolm; Andrew Knox, Kilbirnie, all of United Kingdom

[73] Assignee: International Business Machines Corporation, Armonk, N.Y.

[21] Appl. No.: 08/695,857

[22] Filed: Aug. 9, 1996

[30] Foreign Application Priority Data

Aug. 25, 1995 [GB] United Kingdom ..... 9517465
Dec. 1, 1995 [GB] United Kingdom ..... 9524613

[51] Int. Cl.[6] ..... G09G 3/22

[52] U.S. Cl. ..... 345/74; 345/21

[58] Field of Search ..... 345/74, 75, 55, 345/30, 46, 77, 78, 20, 21, 22; 313/422, 431, 433; 315/111.81, 116, 368.12, 368.13

[56] References Cited

U.S. PATENT DOCUMENTS 4,095,137 6/1978 Oswald ..... 315/368
4,531,122 7/1985 Redfield ..... 345/74
4,617,495 10/1986 Culter ..... 315/368.13
5,041,764 8/1991 Midland et al. ..... 315/368.12
5,424,605 6/1995 Lovoi ..... 313/422
5,747,923 5/1998 Beetson et al. ..... 313/433

*Primary Examiner*—Chanh Nguyen
*Assistant Examiner*—John Suraci
*Attorney, Agent, or Firm*—Scully, Scott, Murphy & Presser; Jay P. Sbrollini, Esq.

[57] ABSTRACT

A display system comprises a display screen including a matrix of display elements and a permanent magnet having an array of channels formed therein. Each channel corresponds to a different display element. Each display element comprises a phosphor target, an electron source and a device for controlling flow of electrons from the source through the corresponding channel in the magnet onto the target. Addressing device comprises first and second orthogonal conductors defining a grid. Each display element is located at the intersection of a different pair of first and second conductors. Each first conductor is connected to a first control electrode of the control device of each display element in a corresponding line of display elements and each second conductor is connected to a second control electrode of the control device of each display element in a corresponding line of display elements.

17 Claims, 8 Drawing Sheets

| BIT 7 | -------- | BIT 0 | BIT 7 | -------- | BIT 0 | BIT 7 | -------- | BIT 0 |
|---|---|---|---|---|---|---|---|---|
| BLUE BYTE | | | GREEN BYTE | | | RED BYTE | | |
| 24 BIT PIXEL COLOUR DATA | | | | | | | | |

MAGNETIC MATRIX DISPLAY DEVICE USING ORTHOGONAL CONDUCTORS

BACKGROUND OF THE INVENTION

1. Technical Field

The present invention relates to a display system comprising a magnetic matrix display device.

2. Prior Art

Magnetic matrix display devices are particularly although not exclusively useful for flat panel display applications. Such applications include television receivers and visual display units for computers, especially although not exclusively portable computers, personal organizers, communications equipment, and the like.

SUMMARY OF THE INVENTION

In accordance with the present invention, there is now provided a display system comprising: a display screen including a matrix of display elements and a permanent magnet having an array of channels formed therein, each channel corresponding to a different display element, each display element comprising a phosphor target, an electron source and control means for controlling flow of electrons from the source through the corresponding channel in the magnet onto the target; and addressing means comprising first and second orthogonal conductors defining a grid, each display element being located at the intersection of a different pair of first and second conductors, each first conductor being connected to a first control electrode of the control means of each display element in a corresponding line of display elements and each second conductor being connected to a second control electrode of the control means of each display element in a corresponding line of display elements.

Preferably, the display system comprises drive circuitry for generating a picture on the display screen in response to a video input, the drive circuitry comprising, for each display element, first driver means for applying an enable pulse to the corresponding first conductor, and second driver means for applying, during the enable pulse, a drive signal determined by the video input, to the corresponding second conductor.

The first driver means preferably comprises pulse shifting means having a plurality of successive outputs each connected to successive row conductors and means for shifting a pulse serially along the successive output in response to a clock signal.

In some embodiments of the present invention, the pulse shifting means comprises a shift register. However, in other embodiments of the present invention, the pulse shifting means may comprise an analogue delay line, in which case brightness control means for varying the amplitude of the enable pulse may be connected to the pulse shifting means.

In particularly preferred embodiments of the present invention, there is provided means for extracting the clock signal from the video input.

Each target preferably comprises a plurality of sub-targets each corresponding to a different color, and the addressing means comprises indexing means for sequentially directing the flow of electrons in each display element onto successive ones of the corresponding sub-targets during the enable pulse.

Preferably, the second drive means comprises: means for extracting from the video input a plurality of video parts each corresponding to a different sub-target of a display element; and means for sequentially varying the drive signal from the display element in dependence on each of the video parts in turn.

The second drive means may comprise an address bus, a data bus, a control bus, and a plurality of convertor means each connected to the control, data, and address buses and each having an output connected to a different second conductor.

In preferred embodiments of the present invention, there is provided deserializer means for generating a parallel digital video data word on the data bus as a function of a digital video bit stream input to the display system; and an address generator for addressing, via the address bus, the data word to a selected one of the convertor means.

Each convertor means preferably comprises a digital to analogue convertor for generating the drive signal on the connected second conductor in response to a digital input derived from the video input.

Contrast control means is preferably connected to each of the digital to analogue convertors. Additionally, color control means may be connected to each of the digital to analogue convertors.

Each convertor means preferably comprises a first register, a second register, a demultiplexor for selectively connecting inputs to the first register and the second register to the data bus, and a multiplexer for selectively connecting the output of the first register and the second register to the input of the digital to analogue convertors.

Preferably, the demultiplexor is arranged to connect one of the first and second registers to the data bus when the multiplexer connects the other of the first and second registers to the input of the digital to analogue convertor.

In especially preferred embodiments of the present invention, the first conductors are column conductors and the second conductors are row conductors.

Viewing the present invention from another aspect, there is provided a display system comprising: a display screen having a matrix of display elements each having sub-display elements each corresponding to a different color, and first and second orthogonal conductors defining a grid, each display element being located at the intersection of a different pair of first and second conductors; and drive circuitry for generating a picture on the display screen in response to a video input comprising a plurality of video parts each corresponding to a different one of the subdisplay elements, the drive circuitry comprising, for each display element, first driver means for applying an enable pulse to the corresponding first conductor, and second driver means for sequentially applying, during the enable pulse, a plurality of second drive signals, each determined by a different one of the video parts, to the corresponding second conductor.

BRIEF DESCRIPTION OF THE DRAWINGS

Preferred embodiments of the present invention will now be described, by way of example only, with reference to the accompanying drawings, in which.

DETAILED DESCRIPTION OF THE PREFERRED EMBODIMENTS OF THE INVENTION

Figure 1:
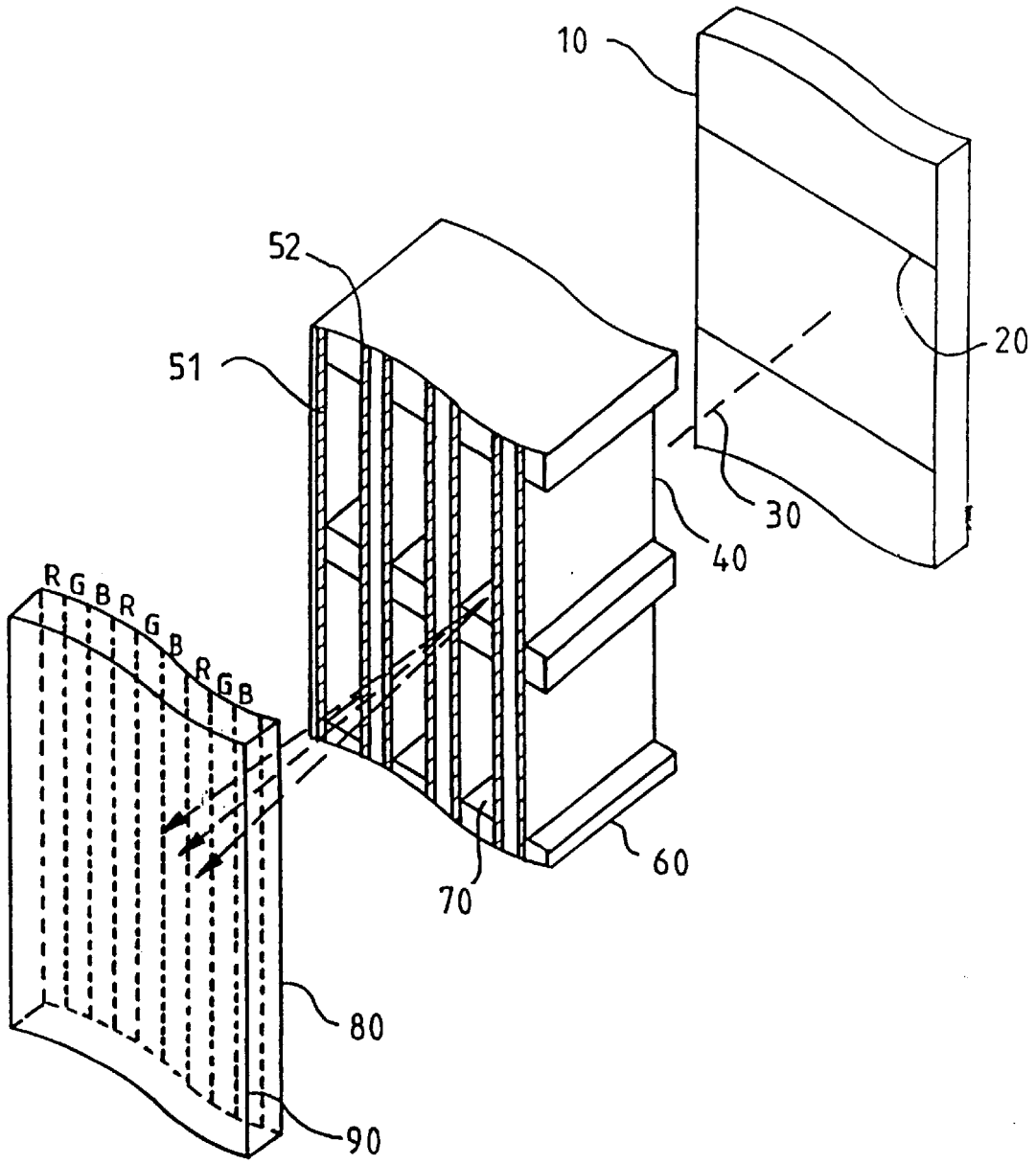
FIG. 1 is an exploded diagram of an example display system of the present invention.

Referring first to FIG. 1, a color magnetic matrix display of the present invention comprises: a first glass plate 10 carrying a cathode 20 and a second glass plate 90 carrying a coating of sequentially arranged red, green and blue phosphor stripes 80 facing the cathode 20. The phosphors are preferably high voltage phosphors. A final anode layer (not shown) is disposed on the phosphor coating 80. A permanent magnet 60 is disposed between glass plates 90 and 10. The magnet is perforated by a two dimension matrix of perforation or "pixel wells" 70. An array of anodes 50 are formed on the surface of the magnet 60 facing the phosphors 80. For the purposes of explanation of the operation of the display, this surface will be referred to as the top of the magnet 60. There is a pair of deflection anodes 51 and 52 associated with each column of the matrix of pixel wells 70. The anodes 51 and 52 of each pair extend along opposite sides of the corresponding column of pixel wells 70. A control grid 40 is formed on the surface of the magnet 60 facing the cathode 10. For the purposes of explanation of the operation of the display, this surface will be referred to as the bottom of the magnet 60. The control grid 40 comprises a first group of parallel control grid conductors extending across the magnet surface in a column direction and a second group of parallel control grid conductors extending across the magnet surface in a row direction so that each pixel well 70 is situated at the intersection of different combination of a row grid conductor and a column grid conductor. As will be described later, plates 10 and 90, and magnet 60 are brought together, sealed and then the whole is evacuated. In operation, electrons are released from the cathode and attracted towards control grid 40. Control grid 40 provides a row/column matrix addressing mechanism for selectively admitting electrons to each pixel well 70. Electrons pass through grid 40 into an addressed pixel well 70. In each pixel well 70, there is an intense magnetic field. The pair of anodes 51 and 52 at the top of pixel well 70 accelerate the electrons through pixel well 70 and provide selective sideways deflection of the emerging electron beam 30. Electron beam 30 is then accelerated towards a higher voltage anode formed on glass plate 90 to produce a high velocity electron beam 30 having sufficient energy to penetrate the anode and reach the underlying phosphors 80 resulting in light output. The higher voltage anode may typically be held at 10 kV.

The magnetic matrix display device is described in more detail in UK patent application No. GB 9517465.2, the contents of which is incorporated herein by reference.

The row and column conductors of control grid 40 each have their own drive signals. The combination of cathode 20, control grid 40, and deflection anodes 50 forms a tetrode structure for each pixel of the display. Matrix addressing by control grid 40 permits individual pixel control without individual row and column control for each pixel. This reduces driver requirements from X×Y for a given resolution to X+Y. Furthermore, with two sets of conductors (row and column) forming control grid 40 (row and column), one can be used for biasing the tetrode and the other used for controlling amplification of the electron beam 30.

As mentioned above, the display is a matrix addressed device where each pixel lies at the intersection of a row conductor and a column conductor. When drive voltages on intersecting row and column conductors are suitable, the pixel at the intersection will illuminate. Scanning may be organized as a raster scan. However, this may lead to low phosphor excitation times and high internal frequencies. A more desirable approach is to activate all pixels on an entire row or column simultaneously. This reduces internal data rate and increases phosphor excitation time, but may require more internal electronic circuitry.

Active matrix liquid crystal displays typically activate an entire row simultaneously. The activated row then progresses down the screen. This is generally known in the art as "row scanning". In row scanning systems, each column has a corresponding analog driver. In a 640×480 pixel display therefore, with 640 pixels per row, the number of column drivers required is 640 per color, giving 1920 column drivers in total.

In preferred embodiments of the present invention, column scanning is employed instead of row scanning. Thus for a 640×480 resolution display, the number of drivers is 480 per color, giving 1520 row drivers in total. It will thus be appreciated then that column scanning offers a reduction in analog driver requirement over row scanning.

Figure 2:
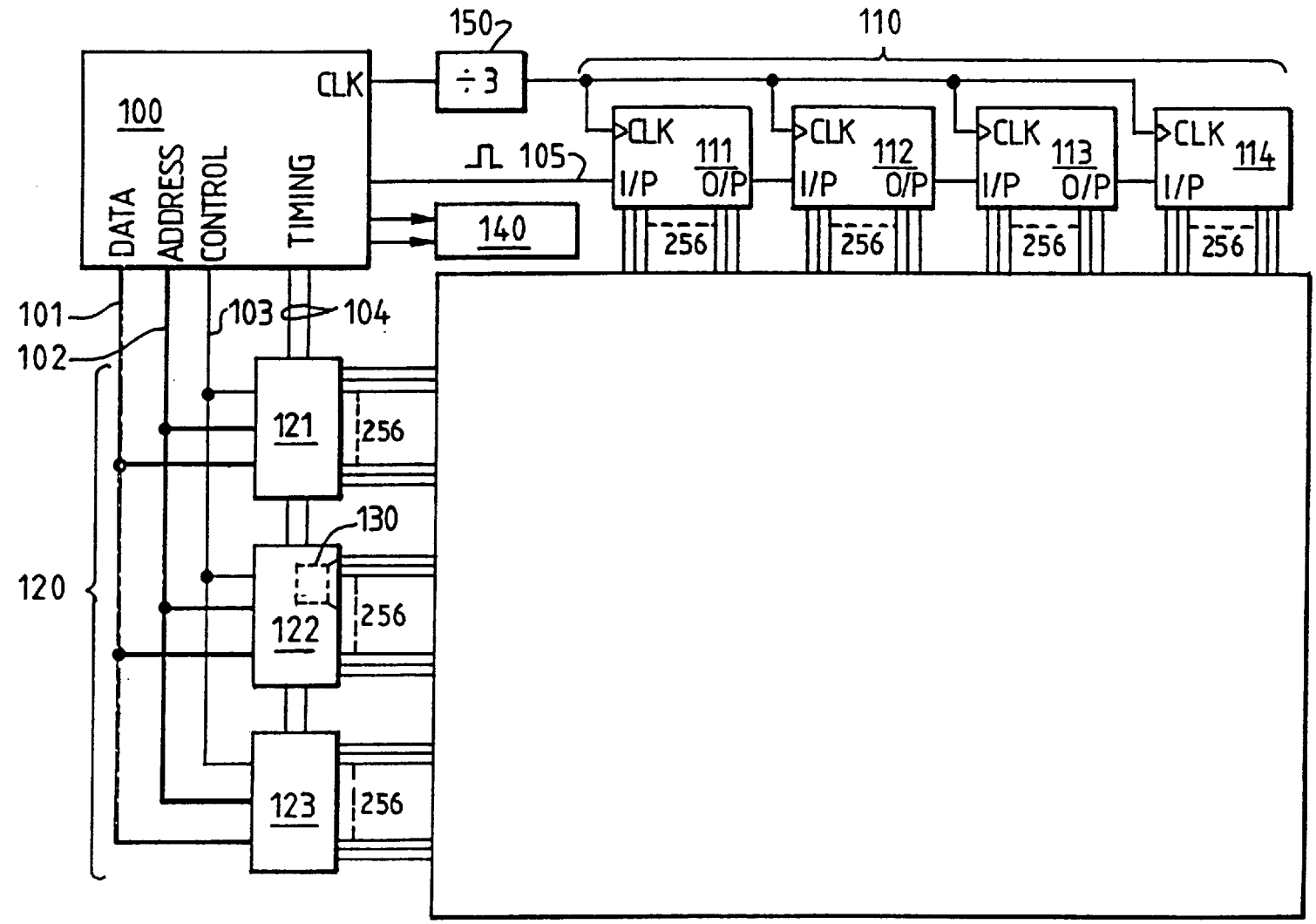
FIG. 2 is a block diagram of the display system.

Referring now to FIG. 2, an example of a display system of the present invention comprises a 1024×768 magnetic matrix display device. Each column conductor of control grid 40 (FIG. 1) is connected to a separate output of column driver means 110. The column driver means 110 comprises four 256 bit shift registers 111–114 connected in series with a common clock input CLK. Each row conductor of control grid 40 is connected to a separate output of row driver means 120. Row driver means 120 comprises 768 row drivers 130 split into blocks 121–123 of 256 row drivers 130. Inputs to row driver means 120 are provided by master timing and deserializer logic 100 via a 24 bit data bus 101, an 8 bit address bus 102, a control bus 103 and timing signal lines 104. A data input together with clock input CLK' for column driver means 110 are also provided by master timing and deserializer logic 100. Clock input CLK' is divided by 3 by counter 150 prior to application to the clock inputs CLK of column driver means 110.

Figure 5A:
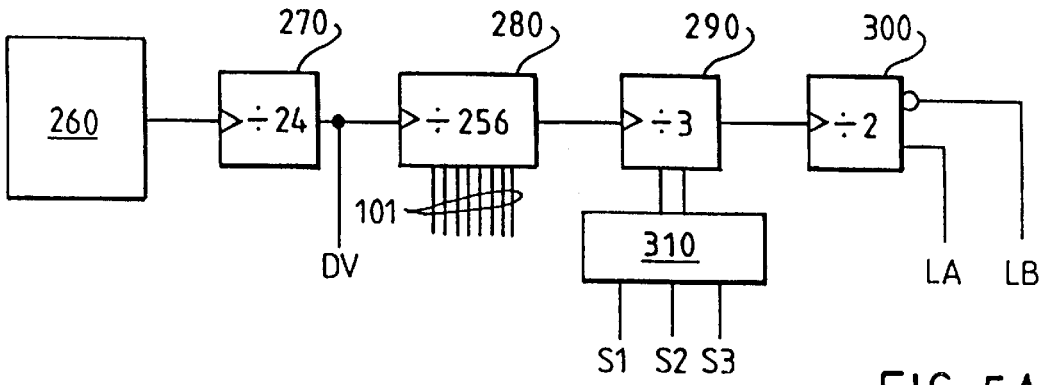
FIG. 5A is a block diagram of row driver loading logic for the display system.

Referring now to FIG. 5A, logic 100 comprises row driver load logic. The row driver load logic comprises a pixel clock recovery circuit 260. The output of clock recovery circuit 260 is connected to the input of a divide-by-24 counter 270. The output of counter 270 provides a data valid signal DV on control bus 103 and timing lines 104. The output of counter 270 is also connected to the input of a divide-by-256 counter 280 having an 8 bit parallel output connected to address bus 101. The output of counter 290 is connected to the input of a divide-by-three counter 290 having a two bit parallel output. The parallel output of counter 290 is connected to the input of a 2:3 demultiplexor 310. The outputs from demultiplexor 310 are connected to chip select lines S1–S3 on control bus 103. The output of counter 290 is connected to the input of a divide-by-two counter 300 having complementary outputs. The output of counter 260 are connected to LA and LB control lines of control bus 103.

Figure 5B:
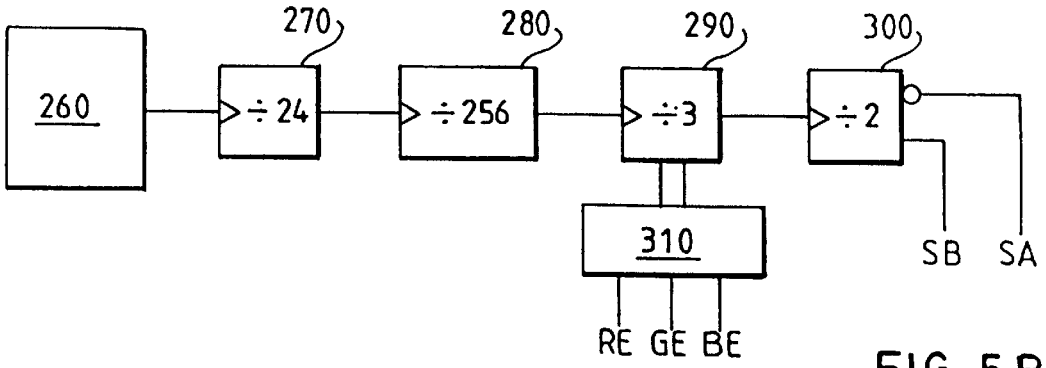
FIG. 5B is a block diagram of row driver output logic for the display system.

Referring now to FIG. 5B, logic 100 also comprises row driver output logic constituted by counters 270–300, clock recovery circuit a pixel clock recovery circuit 260, and demultiplexor 310. The CHIP SELECT outputs of demultiplexor 310 are connected to red, green, and blue enable lines RE, GE, BE of control bus 103. The outputs of counter 300 are connected to SB and SA lines of timing lines 104.

Figure 5C:
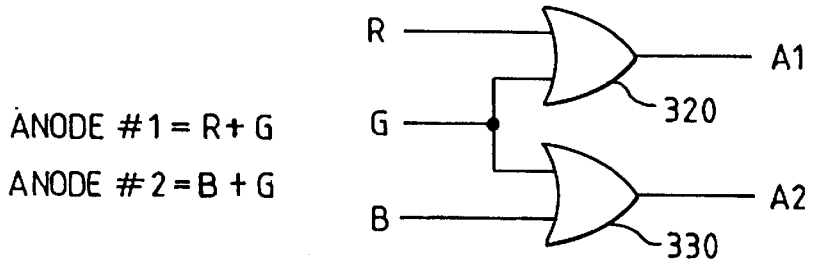
FIG. 5C is a block diagram of deflection anode drive logic for the display system.

Referring now to FIG. 5C, logic 100 further comprises an anode drive circuit for generating drive signals A1 and A2 to drive anode drive means 140 to energize anodes 51 and 52. The anode drive circuit comprises first and second two input OR gates 320 and 330. One input of first OR gate 320 is connected to the RED ENABLE output of demultiplexor 310. The other input of OR gate 320 is connected to the GREEN ENABLE output of demultiplexor 310. The GREEN ENABLE OUTPUT of demultiplexor 310 is also connected to one input of the second OR gate 330. The other input of OR gate 330 is connected to the BLUE ENABLE output.

Figure 5D:
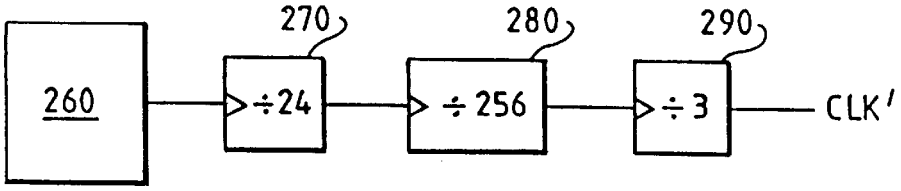
FIG. 5D is a block diagram of a column sequencing logic for the display system.

Referring now to FIG. 5D, logic 100 further includes column sequencing clock logic comprising counters 270, 280, and 290, and clock recovery circuit 260. The output CLK' of counter 290 is connected to clock input CLK of registers 111–114 of column drive means 110 via counter 150.

Figure 6:
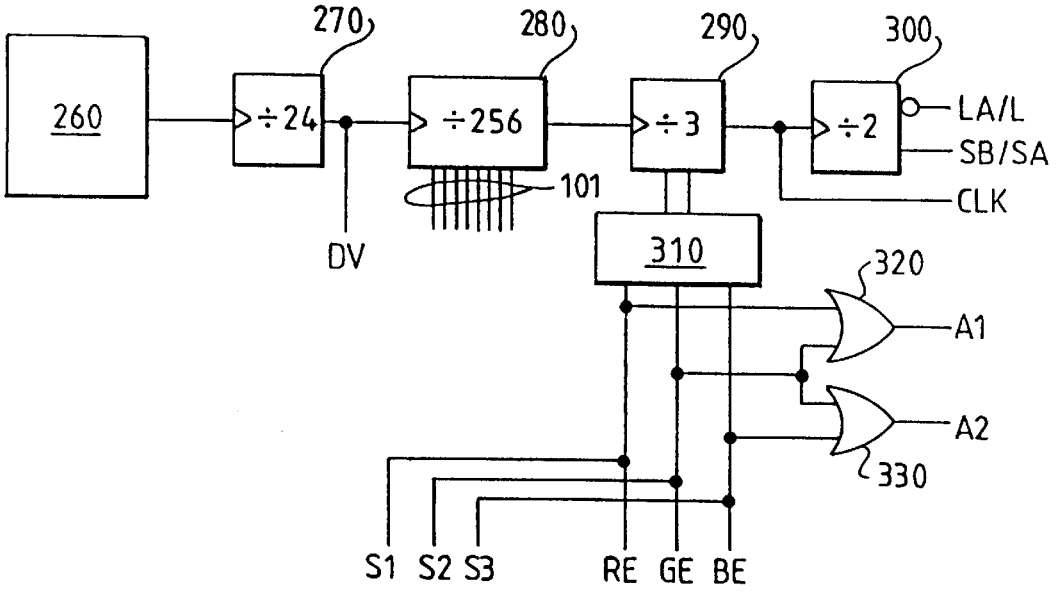
FIG. 6 is a block diagram of master clock logic for the display system.

FIG. 6 shows an arrangement of logic 100 in which the column sequencing clock logic, anode drive logic, row driver load logic and row driver output logic are combined, with the inverting output of counter 300 providing the LA and LB signals on a single line LA/LB of control bus 103, and the non-inverting output of counter 300 providing the SA and SB signals on a signal line SB/SA of timing lines 104.

Figure 3:
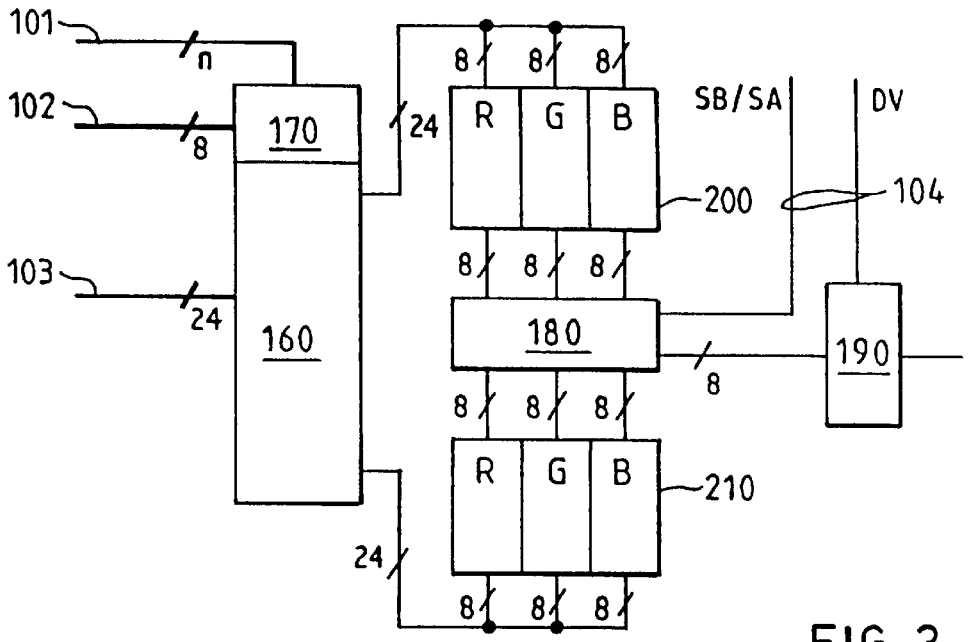
FIG. 3 is a block diagram of a row driver for the display system.

Referring now to FIG. 3, each row driver 130 comprises a first 24 bit register 200 and a second 24 bit register each having parallel outputs selectively connectable to an 8 bit digital to analogue convertor (DAC) 190 via a 48:8 multiplexer 180. DAC 190 has an enable input connected to data valid line DV of timing lines 104. A 24:48 demultiplexor 160 selectively connects the registers 200 and 210 to the data bus 101. A controller 170 is connected to demultiplexor 160. Controller 170 is connected to address bus 102 and control bus 103. Multiplexer 180 has a first control input (not shown) connected to controller 170 and a second control input connected to line SB/SA of timing lines 104.

In operation, logic 100 receives a serial video data stream from an external video source such as a display adaptor of a personal computer system. The image defined by the data stream is produced on the display device by sequentially driving each column in turn from the left hand side. All rows are driven simultaneously by their respective row drivers for each column scanned. Each pixel well 70 in the display device sequentially produces Red, Green and Blue Colors and therefore requires access to all color information associated with the corresponding pixel.

Figures 12, 13:
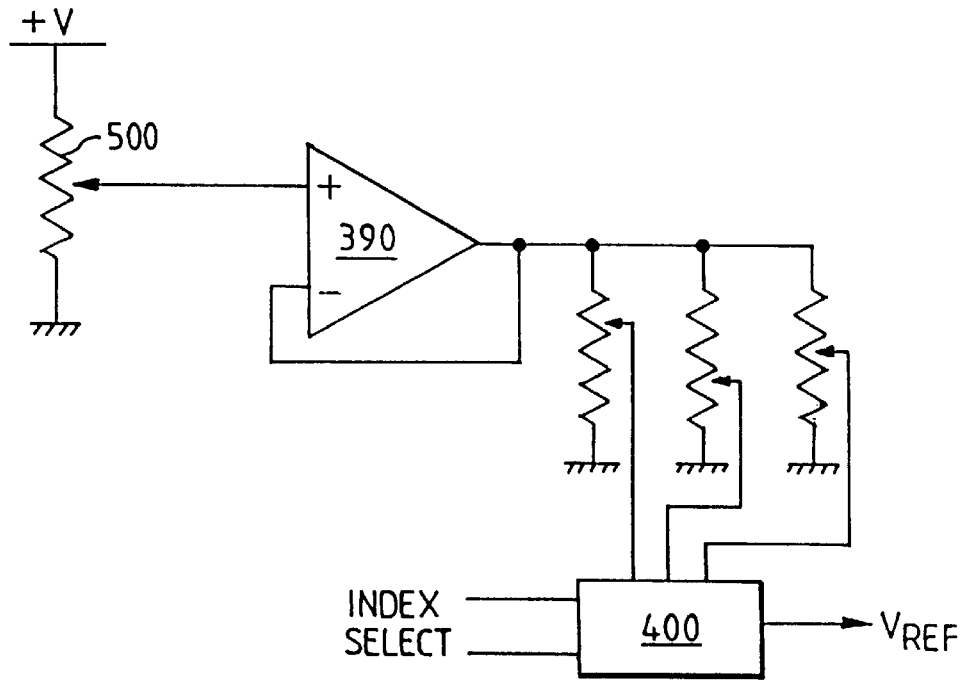
FIG. 12 is a block diagram of another of the contrast control system.
FIG. 13 is a video data block for the display system.

Referring to FIG. 13, each pixel is represented in the data stream by 24 bit word. Each of the Red, Green and Blue colors of the pixel is defined by a different 8 bits of the word. Thus each pixel is associated with a total of 24 bits of color information yielding 16777216 shades. First to arrive at logic 100 is Red Bit 0 and last to arrive is Blue Bit 7. The data stream is ordered such that, for each column, data is sent for all rows starting from the top row and finishing with the bottom row.

Clock recovery circuit 260 reconstructs a pixel clock signal from the input data stream. Logic 100 also comprises a deserializer (not shown) for converting the input data stream back into parallel data with reduced frequency. Logic 100 still further comprises a sync detector (not shown) for detecting frame and column synchronization (sync) pulses from the input data stream for picture synchronization.

24 bit color data extracted from the input data stream for each pixel is routed by logic 100 via data, address, and control buses 101–103 to the row driver associated with each row conductor of control grid 40. The color data is clocked out to the recipient row conductor by timing control signals 104 derived from the reconstructed pixel clock and sync pulses.

Concurrently with row conversion, column driver means 110 is switched under control of the pixel signal in such a manner that the each group of 768 24 bit color data words loaded into the row drivers 130 actuates the correct column of pixels.

Figure 4:
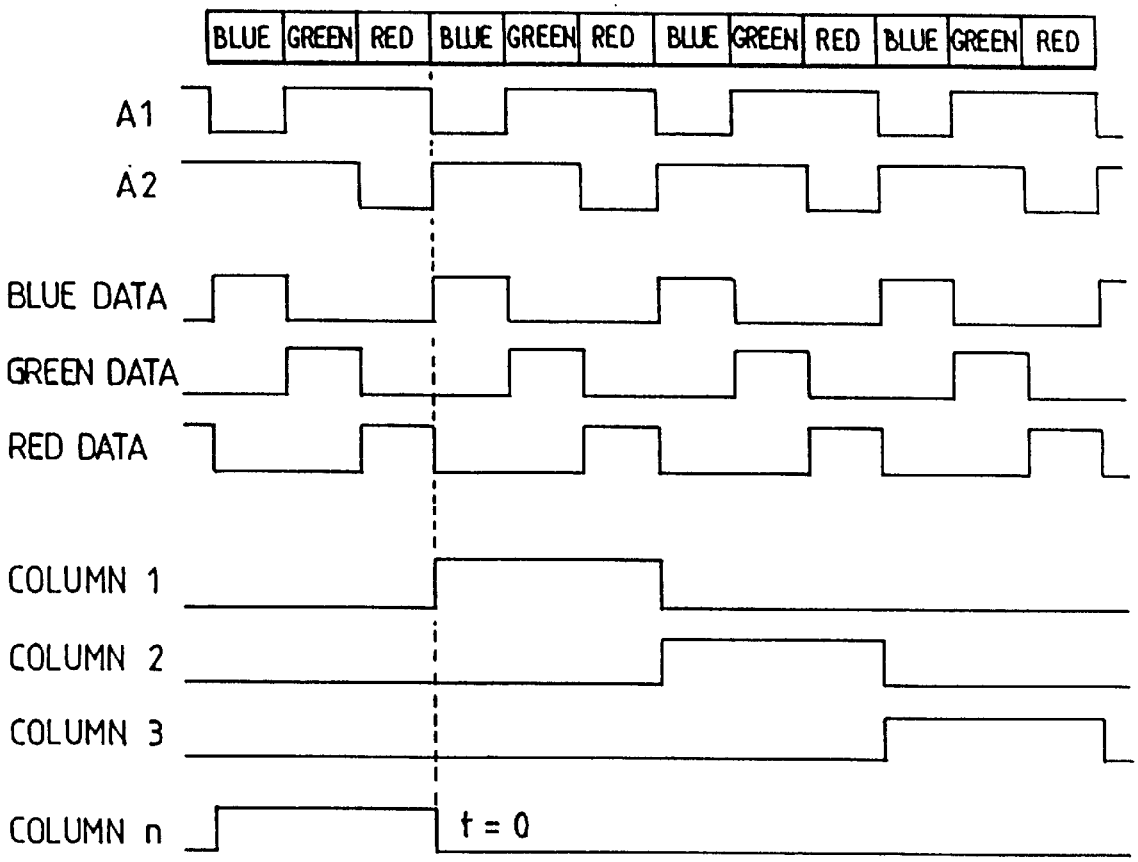
FIG. 4 is a timing diagram associated with the display system.

Referring now to FIG. 4, deflection anodes 51 and 52 are energized under control of waveforms A1 and A2 respectively to scan electron beam 30 from each pixel well 70 across Red, Green and Blue phosphor stripes 80 in the order shown at 152. RED, GREEN and BLUE video signals are sequentially gated onto the row conductors in synchronization with A1 and A2. The clock inputs CLK to column driver means 110 is produced by reducing, via counter 150, the frequency of clock signal CLK' by an amount sufficient to accommodate beam indexing deflection signals A1 an A2 so that for each column of pixels addressed, red, green and blue, phosphor stripes are scanned. Logic 100 produces a column drive pulse which is propagated by columns drive means 110 along register chain 111–114 as illustrated by waveforms COLUMN 1, COLUMN 2, COLUMN 3 up to COLUMN N to sequentially energize successive column conductors across the screen of the display (where N is the total number of columns, 1024 in the present example). Thus, the column drive signal sequentially selects each successive pixel in a given row as it passes along register chain 111–114. As mentioned earlier, each pixel in the display is associated with separate red, green and blue phosphor stripes. To scan each of these during one column period, two steps are taken: a) The 8 bits of data for the respective color is routed from the relevant register 200 or 210 to DAC 190 and converted to produce a quantized analog level on the associated row; and, b) Deflection anodes 51 and 52 are driven such that the electron beam from the relevant pixel well 70 is directed onto the colored phosphor stripe corresponding to the 8 bits of data converted by DAC 190.

It will be appreciated from FIG. 4 that three separate sets of color data for Red, Green, and Blue are sequentially converted to analog signals during each column period. Deflection anode switching is synchronized to the conversions. Referring again to FIG. 5D, counter 290 is provided in clock line CLK feeding column driver means 110 to facilitate this timing format.

As mentioned earlier, the input video stream comprises a column sync signal and a frame sync signal. Each column sync pulse indicates that the video source is about to send a new column of color data. The column sync pulse resets a clock recovery circuit 260 for each new column. Each frame sync pulse resets the column driver means 110 in preparation for the next frame and also provides a gate pulse 105 for brightness level sampling. The gate pulse 105 will discussed in detail later.

Referring again to FIG. 5A, the pixel clock signal recovered by recovery circuit 260 is first divided by 24 by counter 270. A division by 24 is chosen because data bus 101 is 24 bits wide. It will however be appreciated that, in other embodiments of the present invention, each data word may be greater than or less than 24 bits in length. The output of counter 270 is then divided by 256 by counter 280. The 8 parallel outputs of counter 280 address the 24 bits on data bus 101 to the appropriate row driver 130 via address bus 102. The output from counter 270 provides a DATA VALID signal to the appropriate row driver 130 via control bus 103. The output of counter 280 is then divided by counter 290. The 2 bit output of counter 290 provides a control input to demultiplexor 310. The output lines of demultiplexor 310 provide CHIP SELECT lines on control bus 103. Address bus 102 is connected to all three 256 row blocks 121–123 of row driver means 120. Thus each block 121–123 receives the same 8 bit address from counter 280. Each block 121–123 is selected sequentially by the CHIP SELECT output of demultiplexor 310 so that data from data bus 101 is only loaded into one of blocks 121–123 at a time. The complementary outputs LA/LB and SB/SA of counter 300 are toggled by the output of counter 290. The LA/LB line of control bus 103 is thus toggled between two states LA and LB. When the LA/LB line is in the LA state, controller 170 configures demultiplexor 160 to connect the data bus 101 to register 200. When the LA/LB line is in the LB state, controller 170 configures demultiplexor 160 to connect the data bus 101 to register 210. The data valid signal DV on control bus 170 triggers, via controller 170, the register connected to data bus 101 via demultiplexor 160 to load the 24 bit data word on the data bus 101. Whilst color data for the next column is loaded from data bus 101 into one of registers 200 and 210, the data stored in the other of registers 200 and 210 is converted by DAC 190 into analog video levels for driving the corresponding row conductor.

Thus, at any time, data can be loaded into one of registers 200 and 210 while the other register is providing data to the DAC 190. These events are completely asynchronous. However, both registers 200 and 210 cannot be accessed from the same side concurrently. This loading method advantageously permits data to be imported from the video source continuously and at a slower rate than conventional display systems as no blanking time is required.

As mentioned earlier, multiplexer 180 has 48 inputs and 8 outputs. The inputs of multiplexer 180 are divided into two groups of 24, with one group connected to the output of register 200 and the other group connected to output of register 210. Each group is sub-divided into 3 sub-groups of 8 inputs. Each sub-group is connected to different 8 bit portion, R, G, and B, of the corresponding register 200, 210. Each 8 bit portion stored a different color data value of the 24 bit pixel word loaded into the register 200, 210. Referring back to FIG. 5B, counter 300 toggles the SB/SA line of timing lines 104 between to states SB and SA. When the SB/SA line is in the SA state, the group of inputs of multiplexer 180 connected to register 200 is activated. When the SB/SA line is in the SB state, the group of inputs of multiplexer 180 connected to register 210 is activated. Enable lines RE, GE, and BE of control bus 103 select, via controller 107, which one of the 3 sub-groups of the group of inputs selected by the SB/SA line is connected to the 8 bit output of multiplexer 180 and thus to the input to DAC 190. The data valid signal DV of timing lines 104 causes DAC 190 convert the 8 bits selected via multiplexer 180 into an analog video level on the associated row conductor.

The data rate of the incoming video stream may be of the order of 1.51 GigaBits/sec. The frequency of the pixel clock generated by recovery circuit may thus be of the order of 1.51 GHz. The data valid signal DV may thus have a frequency of 63 MHz. The output of counter 280 may thus have a frequency of 250 kHz. Thus, the output of counter 290 may have a frequency of 82 kHz. It will thus be appreciated that, despite relatively high input data rates, most of logic 100 can be implemented with relatively low frequency, and thus relatively low cost semiconductor technology.

In a modification to the preferred embodiment of the present invention hereinbefore described, there is provided brightness control means for adjusting the brightness and contrast control means for adjusting the contrast of the displayed image. Both the brightness and contrast control means operate by biasing the operating point of the aforementioned tetrode structure of each pixel. Specifically, in a particularly preferred embodiment of the present invention, brightness control is implemented by introducing a degree of adjustment to the quiescent operating current flowing between the cathode 20 and the final anode for all pixels of the display device. In an especially preferred embodiment of the present invention, contrast control is implemented by introducing a variable scaling factor to the transfer function of the DAC 190 in each row driver 130, e.g.: $V_{out}=kV_{ref}$ X DATA, where $V_{out}$ is the output voltage from the DAC 190; $V_{ref}$ is the DAC reference voltage; DATA is the 8 bit input to the DAC; and, k is the variable scaling factor. It will be appreciated that k may be the same for each of Red, Green and Blue color components of the pixels addressed by the DAC 190 to give contrast control only. Alternatively, there may be separate variables of k for each color component, $k_{red}$, $k_{green}$, and $k_{blue}$, to provide color control.

In the preferred embodiment of the present invention hereinbefore described with reference to FIG. 2, the outputs of the column drive means 110 were binary, having either a high voltage state allowing the row driver means 120 to set the pixel intensity or a low voltage state effectively disabling the corresponding column of pixels by preventing electron flow, even with maximum output for the row driver means 120.

In a modification to the preferred embodiment of the present invention hereinbefore described, each output of the register chain 111–114 is connected to an individual transistor buffer circuit. The buffer circuits are all fed by a common variable brightness reference voltage. In operation, one of the buffer circuits is turned on by the corresponding output from the column river means 110, the reference voltage is effectively gated onto the corresponding column of pixels. A problem with this arrangement is that it introduces many more discrete electronic components to the display system (1024 buffer circuits).

Figure 7A:
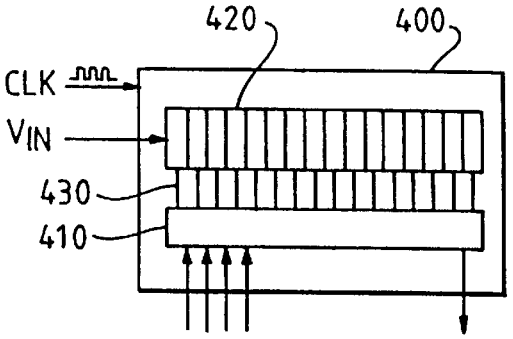
FIG. 7A (PRIOR ART)
FIG. 7A is a block diagram of an analog delay line associated with a preferred embodiment of the present invention.
Figure 7B:
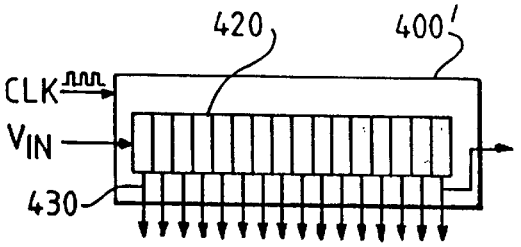
FIG. 7B is a block diagram of a conventional analog delay line.

Referring now to FIG. 7B, in an alternative modification of the preferred embodiment of the present invention hereinbefore described, the register chain 111–14 is replaced by an analog "bucket brigade" delay line 400'.

Referring now to FIG. 7A, a conventional bucket brigade delay line 400 comprises a chain 420 of charge coupled devices each having a tap 430 from which an incremental delay of an input signal $V_{in}$ can be obtained in use. The taps 430 are connected to selection logic 410 which permits a user to program a desired delay into the delay line according to application.

Referring back to FIG. 7B, the aforementioned alternative modification of the preferred embodiment of the present invention the delay line 400' is modified from the conventional design by removing the selection logic 410. This is because all the taps are required to be made available. There are 1024 taps each connected to a different one of the column conductors of control grid 40. Column clock signal CLK is connected to a clock input of the delay line 400'.

Figure 8A:
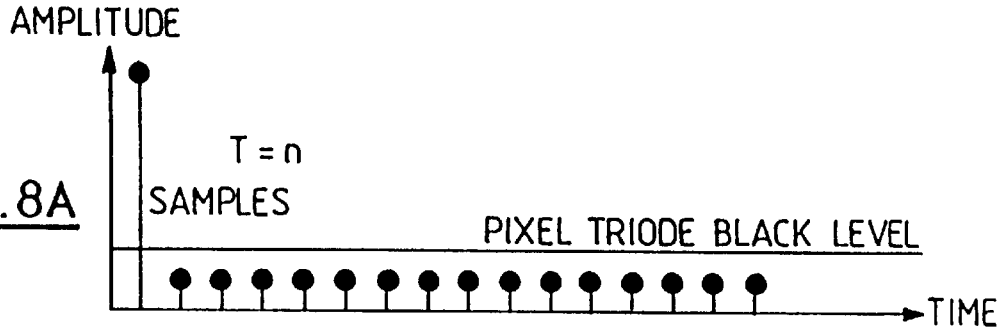
FIGS. 8A to 8C are timing diagrams showing the progress of a pulse through the delay line of FIG. 7A.
Figure 8B:
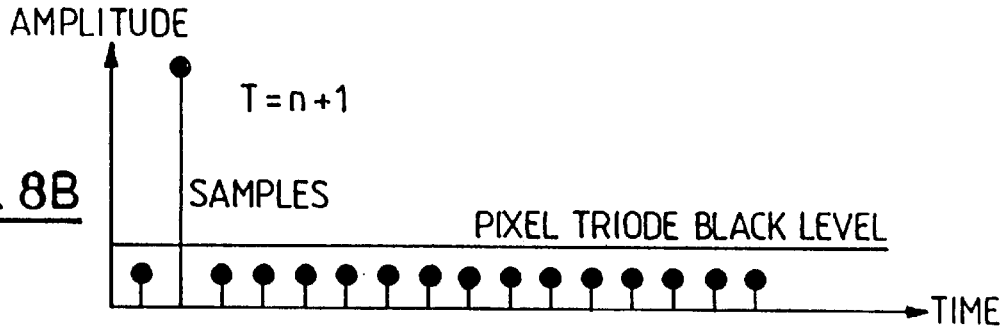
Figure 8C:
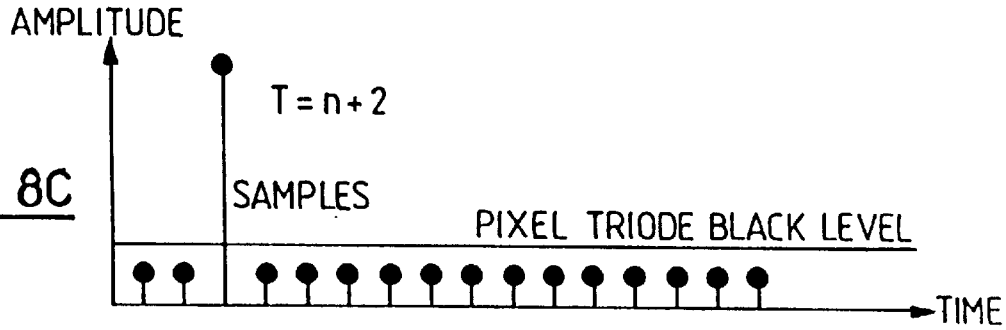

In operation, at the start of each frame, an adjustable voltage $V_{in}$ is sampled by the first tap 430 of the chain 420. Each charge coupled device in the chain 420 transfers the sampled voltage to the next in response to the column clock signal from counter 150. The sampled voltage determines the brightness of the displayed picture. With the exception of the tap carrying the pulse, all taps of delay line 400' are held at a voltage below the cut-off or "black" level of the pixel tetrode structure to prevent spurious picture distortions. The sampled voltage is effectively produces a pulse which is shifted along the chain 420 by the column clock signal CLK. FIGS. 8A to 8C demonstrate the progress of the pulse through the delay line 400'.

Figure 9A:
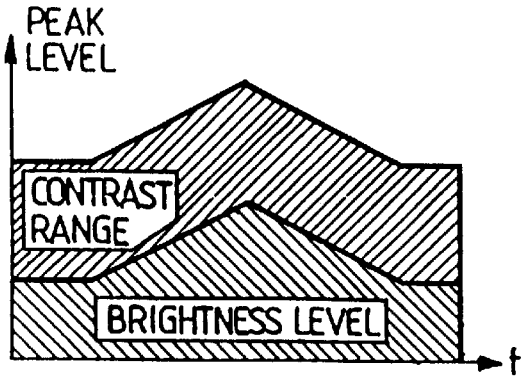
FIG. 9A is a graph relating brightness and contrast to time for a picture brightness control system with constant contrast.
Figure 9B:
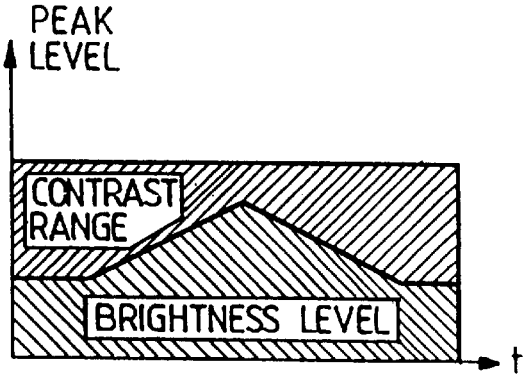
FIG. 9B is a graph relating brightness and contrast to time for a picture brightness control system with variable black level.

With reference to FIG. 9A, one method of brightness control involves maintaining a constant amplitude contrast range imposed on a variable black level. Referring now to FIG. 9B, another method of brightness control involves maintaining a constant peak output level and varying the black level at the expense of reduce contrast range. Either of these methods may be employed in embodiments of the present invention.

Figure 10:
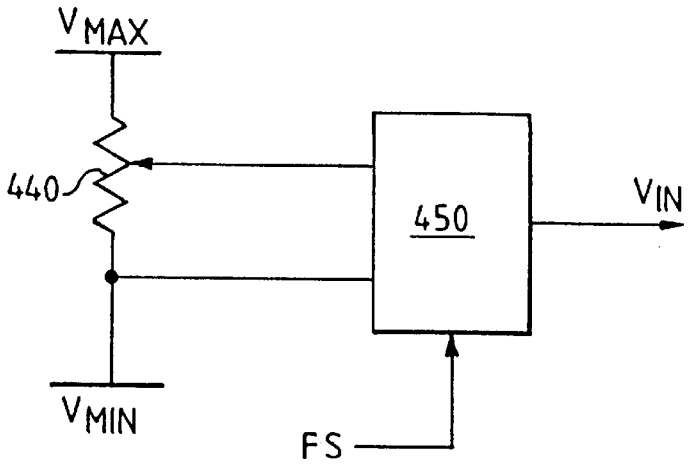
FIG. 10 is a block diagram of a brightness control system for an embodiment of the present invention.

Referring now to FIG. 10, in a preferred embodiment of the present invention, the voltage level $V_{in}$ sampled by delay line 400' is provided by a brightness control circuit comprising a potentiometer 440 connected at one end to a maximum brightness voltage level $V_{max}$ and to a minimum brightness voltage level $V_{min}$, where $V_{min}$ is at the black level of the pixel tetrode structure, at the other end. The wiper of the potentiometer 440 is connected to one input of a two input analog multiplexer 450. The other input of the multiplexer 450 is connected to $V_{min}$. A control input to multiplexer 450 is connected to the frame sync signal FS from logic 100. The output from multiplexer 450 is connected to the input of delay line 400'. In operation, each frame sync pulse triggers the multiplexer 450 to shift the input to the delay line 400' from $V_{min}$ to the voltage level at the wiper of potentiometer 440. In the absence of a frame sync pulse, the input of delay line 400' is maintained at $V_{min}$.

Figure 11:
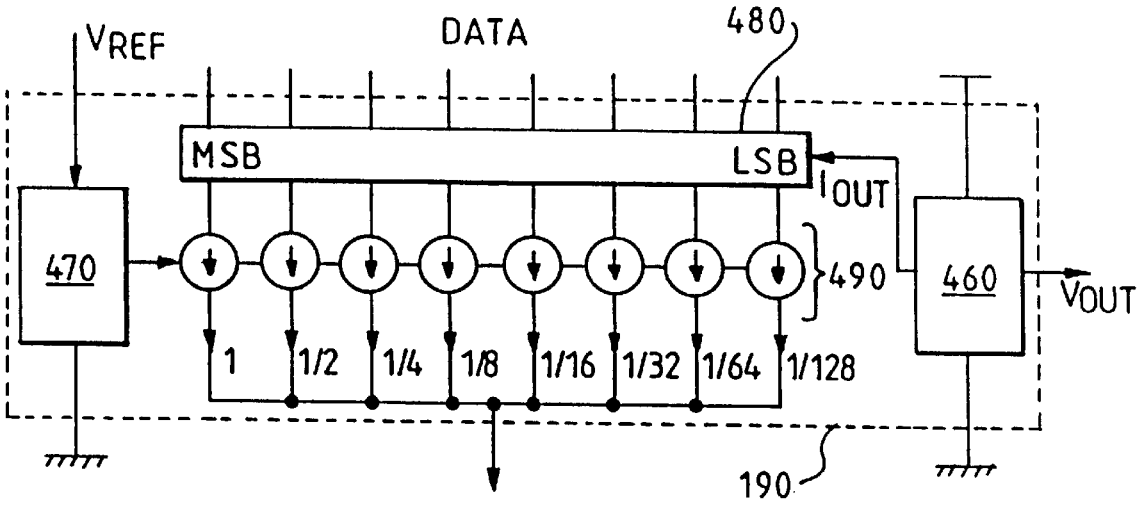
FIG. 11 is a block diagram of part of a contrast control system, for an embodiment of the present invention.

Referring now to FIG. 11, in a particularly preferred embodiment of the present invention, the DAC 190 of each row driver 130 is an 8 bit current mode DAC comprising a bank of ratioed current sinks 490. Sinks 490 are selectively connectable in parallel in dependence upon the 8 bit input DATA from multiplexer 180 via a switch array 480. A transconductance amplifier 460 is connected to the switch array 480. A variable current reference 470 is connected to the sinks 490.

In operation, the sum $I_{out}$ of the currents flowing through sinks 490 is drawn out through switch array 480. Sinks 490 are selectively connectable in parallel via switch array 480 in accordance with 8 bit input DATA. The summed current is converted to an output voltage $V_{out}$ for driving the row conductors by transconductance stage 460. The summed current passed through sinks 480 is dumped to suitable reference voltage supply rail. Although the ratio of current sinks 480 is fixed, the absolute current for each sink is determined by current reference 470. Current reference 470 is set by external voltage input $V_{ref}$. It will thus be appreciated that variable contrast control may be provided by introducing means for varying $V_{ref}$. $V_{ref}$ allows true analog control over the output of DAC 190 rather than quantized control.

Referring now to FIG. 12, an especially preferred embodiment of the present invention, includes combined contrast and color control means for varying reference voltage $V_{ref}$ to DACs 190. The contrast and color control means comprises a potentiometer 500 having a track connected at one end to a higher level voltage supply V+ and at the other end to a lower level voltage supply. The wiper of potentiometer 500 is connected to the input of a buffer amplifier 390. The output of buffer 390 is connected to one end of the tracks of three potentiometers 501–503. The other end of the tracks of potentiometers 501–503 is connected to the lower voltage supply. The wipers of potentiometers 501–503 are connected to the inputs of an analogue multiplexer 400. Multiplexer 400 has two control inputs each of which is connected to a different one of beam indexing signals A1 and A2. The output of multiplexer 400 is connected to the $V_{ref}$ input of the DACs 190.

In operation, a user can adjust the contrast of the display by adjusting potentiometer 500. The voltage selected by potentiometer 500 is then provided to potentiometers 501–503 via buffer 390. Each color intensity can be adjusted relative to the other color intensities by adjusting a corresponding one of potentiometers 501–503. As aforementioned, each row driver sequentially converts R, G, and B data into row drive voltages for each pixel in the corresponding row. In synchronization with the sequential conversion, the electron beam corresponding to each pixel is sequentially indexed to each color sub-pixel of the pixel by indexing signals A1 and A2. The indexing signals selected the color control voltage via multiplexer 400 corresponding to the sub-pixel indexed, thereby setting $V_{ref}$ in accordance with color. By varying reference voltage $V_{ref}$ as each color is converted, variations in relative color intensity may be introduced. By applying the contrast control voltage to the input of the color control, the color control values track each other, thereby maintaining a constant color point of the display despite changes in contrast setting.

Preferred embodiments of the present invention have been hereinbefore described with reference to a magnetic matrix display. It will however, be appreciated that at least some of the features described may be applicable to other display technologies such as, for example, field emission display technologies.

In summary, the present invention, viewed from one aspect, relates generally to a display system comprising: a display screen including a matrix of display elements and a permanent magnet having an array of channels formed therein, each channel corresponding to a different display element, each display element comprising a phosphor target, an electron source and means for controlling flow of electrons from the source through the corresponding channel in the magnet onto the target.

In particular, the present invention hereinbefore described relates to a display system comprising: a display screen including a matrix of display elements and a permanent magnet having an array of channels formed therein, each channel corresponding to a different display element, each display element comprising a phosphor target, an electron source and means for controlling flow of electrons from the source through the corresponding channel in the magnet onto the target; addressing means comprising first and second orthogonal conductors defining a grid, each display element being located at the intersection of a different pair of first and second conductors, each first conductor being connected to a first control electrode of the tetrode means of each display element in a corresponding line of display elements and each second conductor being connected to a second control electrode of the tetrode means of each display element in a corresponding line of display elements.

While the invention has been particularly shown and described with respect to (a) preferred embodiment(s) thereof, it will be understood by those skilled in the art that the foregoing and other changes in form and details may be made therein without departing from the spirit and scope of the invention.

Having thus described our invention, what we claim as new, and desire to secure by Letters Patent is:

1. A display system comprising:

a display screen including a matrix of display elements and a permanent magnet having an array of channels formed therein, each channel; corresponding to a different display element, each display element comprising a phosphor target, an electron source and control means for controlling flow of electrons from the source through the corresponding channel in the magnet onto the target; and addressing means comprising orthogonal row and column conductors defining a grid, each display element being located at the intersection of a different pair of row and column conductors, each row conductor being connected to a first control electrode of the control means of each display element in a corresponding row of display elements, and each column conductor being connected to a second control electrode of the control means of each display element in a corresponding column of display elements, the addressing means including means to provide each of the row and column conductors with a respective drive signal.

2. A display system as claimed in claim 1, comprising drive circuitry for generating a picture on the display screen in response to a video input, the drive circuitry comprising, for each display element, first driver means for applying an enable pulse to the corresponding first conductor, and second driver means for applying, during the enable pulse, a drive signal determined by the video input, to the corresponding second conductor.

3. A display system as claimed in claim 2, wherein the first driver means comprises pulse shifting means having a plurality of successive outputs each connected to successive first conductors and means for shifting a pulse serially along the successive output in response to a clock signal.

4. A display system as claimed in claim 3, wherein the pulse shifting means comprises a shift register.

5. A display system as claimed in claim 3, wherein the pulse shifting means comprises an analogue delay line.

6. A display system as claimed in claim 5, comprising brightness control means for varying the amplitude of the enable pulse.

7. A display system as claimed in claim 3, comprising means for extracting the clock signal from the video input.

8. A display system as claimed in claim 2, wherein each target comprises a plurality of subtargets each corresponding to a different color, and the addressing means comprises indexing means for sequentially directing the flow of electrons in each display element onto successive ones of the corresponding sub-targets during the enable pulse.

9. A display system as claimed in claim 8, wherein the second driver means comprises: means for extracting from the video input a plurality of video parts each corresponding to a different sub-target of a display element; and means for sequentially varying the drive signal from the display element in dependence on each of the video parts in turn.

10. A display system as claimed in claim 2, wherein the second driver means comprises an address bus, a data bus, a control bus, and a plurality of convertor means each connected to the control, data, and address buses and each having an output connected to a different second conductor.

11. A display system as claimed in claim 10, comprising deserializer means for generating a parallel digital video data word on the data bus as a function of a digital video bit stream input to the display system; and an address generator for addressing, via the address bus, the data word to a selected one of the convertor means.

12. A display system as claimed in claim 11, wherein each convertor means comprises a digital to analogue convertor for generating the drive signal on the connected second conductor in response to a digital input derived from the video input.

13. A display system as claimed in claim 12, comprising contrast control means connected to each of the digital to analogue convertors.

14. A display system as claimed in claim 13, comprising color control means connected to each of the digital to analogue convertors.

15. A display system as claimed in claim 12, wherein each convertor means comprises a first register, a second register, a demultiplexor for selectively connecting inputs to the first register and the second register to the data bus, and a multiplexer for selectively connecting the output of the first register and the second register to the input of the digital to analogue convertors.

16. A display system as claimed in claim 15, wherein the demultiplexor is arranged to connect one of the first and second registers to the data bus when the multiplexer connects the other of the first and second registers to the input of the digital to analogue convertor.

17. A display system as claimed in claim 1, wherein the first conductors are column conductors and the second conductors are row conductors.

* * * * *